US005803281A

United States Patent [19]

Towns

[11] Patent Number: 5,803,281

[45] Date of Patent: Sep. 8, 1998

[54] SYNTHETIC RESINOUS CONTAINER CLOSURE HAVING FRUSTOCONICAL SEALING SURFACES

[75] Inventor: Edward J. Towns, Mathews, N.C.

[73] Assignee: Oz Worldwide, Inc., Monroe, N.C.

[21] Appl. No.: 75,409

[22] Filed: Jun. 14, 1993

[51] Int. Cl.[6] ..... B65D 1/02

[52] U.S. Cl. ..... 215/44; 215/45; 215/252; 215/307; 215/321; 215/341

[58] Field of Search ..... 215/31, 252, 307, 215/321, 341, 344

[56] References Cited

U.S. PATENT DOCUMENTS

| | | | |
|---|---|---|---|
| 491,119 | 2/1893 | Lauhoff | 215/341 X |
| 4,200,196 | 4/1980 | Bashour | 215/253 |
| 4,444,332 | 4/1984 | Widen et al. | 220/306 |
| 4,531,650 | 7/1985 | Friendship | 215/256 |
| 4,592,475 | 6/1986 | Hannon et al. | 215/252 |
| 4,699,287 | 10/1987 | Bullock | 215/256 |
| 5,004,112 | 4/1991 | McBride | 215/252 |
| 5,009,323 | 4/1991 | Montgomery et al. | 215/252 |
| 5,026,538 | 6/1991 | Ochs | 215/260 |
| 5,050,753 | 9/1991 | Trump et al. | 215/252 |
| 5,121,859 | 6/1992 | Stull | 222/541 |

FOREIGN PATENT DOCUMENTS

| | | | |
|---|---|---|---|
| 2124100 | 11/1972 | Germany | 215/341 |

*Primary Examiner*—Stephen Cronin
*Attorney, Agent, or Firm*—Charles E. Temko

[57] ABSTRACT

The disclosure relates to synthetic resinous container closures having frustoconical sealing surfaces which cooperate with corresponding sealing surfaces on a container finish to effect a gas-type seal. In one embodiment, the closure is particularly suited for use in sealing containers having pressurized contents such as carbonated drinks and the like. In a second embodiment, the closure is of threaded type enabling the reclosing and sealing of the engaged container after an initial opening. This embodiment including a separable tamper-indicating ring. In a third embodiment, the closure is adapted to be used in conjunction with an aerosol dispenser to exclude ambient moisture from the area of the dispensing nozzle prior to first use, and to form a second seal after the closure has been removed for first usage.

12 Claims, 5 Drawing Sheets

SYNTHETIC RESINOUS CONTAINER CLOSURE HAVING FRUSTOCONICAL SEALING SURFACES

RELATED APPLICATIONS

Reference is made to my copending joint application with Edward M. Brown, Ser. No. 848,228 filed Mar. 9, 1992; and copending application Ser. No. 936,298 filed Aug. 28, 1992 under the title "Method of Making A Bottle Finish" which disclose and claim related inventions.

BACKGROUND OF THE INVENTION

This invention relates generally to the field of container closures employed inter alia, for the sealing of containers carrying pressurized contents, and more particularly to closures of this type incorporating frustoconical sealing areas which mate with corresponding sealing surfaces on the neck or finish of the container.

As disclosed in the above identified application Ser. No. 848,228, devices of this type, as contrasted with the well-known "crown" type closure include an end wall and a cylindrical side wall, the inner surface of the side wall forming a frustoconical sealing surface which, when in engaged condition, forms the entire sealing area, the end wall normally being spaced from engagement with the mouth of the container by as much as 0.025 inch. This spacing permits the top loading of the container, as for example, when containers are in stacked crated condition, without disrupting the sealing function of the closure. Should such load occur, the closure slides axially over the corresponding sealing surface of the container finish without loss of pressure, the closure expanding radially under the resultant camming action. When the top load is removed, the closure returns to its initial relation with respect to the finish, again, without loss of pressure. This type of closure eliminates the need for end wall sealing gaskets as well as plug-like extensions on the inner surface of the end wall of the closure. As a result, the closure vents at an early stage of removal, eliminating the possibly dangerous effect sometimes experienced with the removal of a cork from a bottle of champagne or sparkling wine. This type of construction has a distinct advantage in that it requires relatively small amounts of material to form the closure with resultant savings in the cost of manufacture. Because the sealing surfaces are displaced from the rim surface defining the mouth of the closure, minor damage to the rim surfaces, as often occurs when the container is reused or recycled, does not affect the ability of the closure to maintain a pressurized seal.

SUMMARY OF THE INVENTION

Briefly stated, the present invention contemplates significant structural improvements over that disclosed in the above mentioned applications which provide an improved sealing function as well as the extension of the frustoconical sealing surface concept to use with containers other than the single or multiple use beverage container. In a first embodiment, the device has been improved by the addition of a closure retaining bead at a peripheral edge of the sealing surface which assists in retention of the closure in sealed position. The band is of segmented form to enable easier removal with an opening tool, and provide an improved initial venting action. The improved bead also facilitates engagement of the closure with the container finish after an initial filling.

A second embodiment discloses a version equipped with threaded container engagement means and a tamper-indicating ring of known type which permits application of the inventive concept to resealable containers, e.g. larger beverage containers and non-comestible contents. In this embodiment, the related position of the sealing surfaces on the closure and container is determined by the degree to which the closure is tightened, although initial installation with the tamper-indicating ring may utilize its presence to determine an initial relative position between the container finish and the closure.

In a third embodiment, the frustoconical sealing surface is included in a manually removable tear strip which serves as the initial seal and tamper-indicating means. A second tapered edge at the smaller end of the frustoconical sealing area enables the remaining part of the closure to be reengaged with the container neck to provide a moisture-proof non-pressurized seal.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
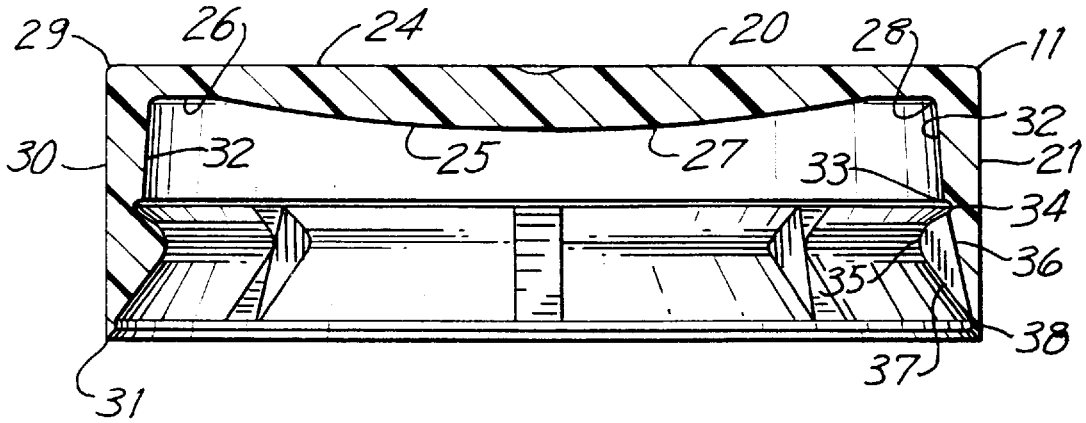
FIG. 1 is a vertical central sectional view of a closure element forming part of a first disclosed embodiment of the invention.
Figure 2:
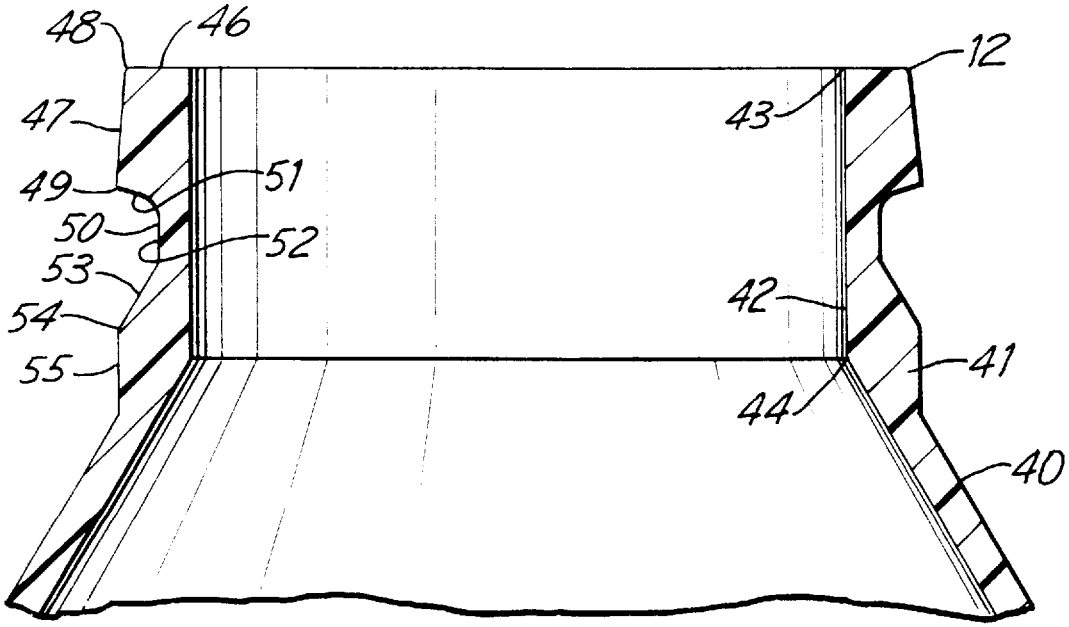
FIG. 2 is a vertical central sectional view of a container element forming another part of the first embodiment.

In accordance with the first embodiment of the invention, the device, generally indicated by reference character 10 comprises broadly: a closure element 11 (FIG. 1), and a container element 12 (FIG. 2).

The closure element 11 is most suitably formed as an injection molding from suitable synthetic resinous materials. We have found polypropylene to be particularly desirable because of high strength and resiliency per unit volume. It includes a generally planar end wall 20 and a cylindrical wall 21.

The end wall is bounded by an upper surface 24 and a lower surface 25 including an arcuate planar portion 26 and a centrally positioned domed surface 27. The wall 20 is bounded by an inner edge 28 and an outer edge 29.

The side wall 21 is bounded by a generally cylindrical outer surface 30 terminating in a lower edge 31 which is feathered to provide tamper indicating means. A frustoconical sealing surface 32 extends from the edge 28 to a lower edge 33, in turn immediately above an annular recess 34 which forms an annular ring of relatively thin cross-section to more readily allow radial expansion of that part of the closure disposed therebelow. Below the recess 34 is an inwardly directed retaining bead 35 bounded by a rounded surface 36 and a tapered surface 37 which extends to a lower edge 38 above the edge 31. Axially disposed slots 39 form gas vents operative during opening of the container and also facilitating rupturing of the bead.

The container element 12, as has been mentioned, is preferably formed from synthetic resinous materials, rather than glass, so that the neck portion 40 may possess a degree of resiliency. The portion 40 includes an upper cylindrical part 41 forming a cylindrical inner surface 42 terminating at an upper edge 43 and a lower edge 44 at which point the inner surface 45 becomes conical. Surrounding the upper edge 43 is an upper annular surface 46 which serves to position the closure when engaged, but which provides only a nominal sealing action. Extending downwardly from the surface 46 is a frustoconical sealing surface adapted to mate with the surface 32 of the closure, which extends from an upper edge 48 to a lower edge 49. The degree of conicity may, in theory, extend from as little as two degrees to as much as thirty degrees. However, we have found that a taper of approximately five degrees with respect to the principal axis of the container is most effective from the standpoint of easy application of the closure upon the container finish, and high pressure on the mated sealing surfaces. For example, where the taper is two degrees, there is less camming action tending to expand the sealing surface on the closure and contract the sealing surface on the container finish, thereby making application of the closure somewhat more difficult. Once engaged, static frictional engagement is relatively high. Where the angle of taper exceeds five degrees to a substantial extent, the reverse is true. While the sealing surfaces are more readily expanded or contracted with relatively less applied force to engage the closure, it follows that the force retaining the closure upon the container finish must be correspondingly higher, thus suiting such wider angle better for use with a threaded closure of the type disclosed in the second embodiment.

Extending below the sealing surfaces is a bead receiving recess to bounded by an upper surface 51, a cylindrical surface 52 and a lower surface 53 extending to an edge 54. Below the edge 54, the cylindrical surface 55 merges with the tapered portion of the neck of the container.

Figure 3:
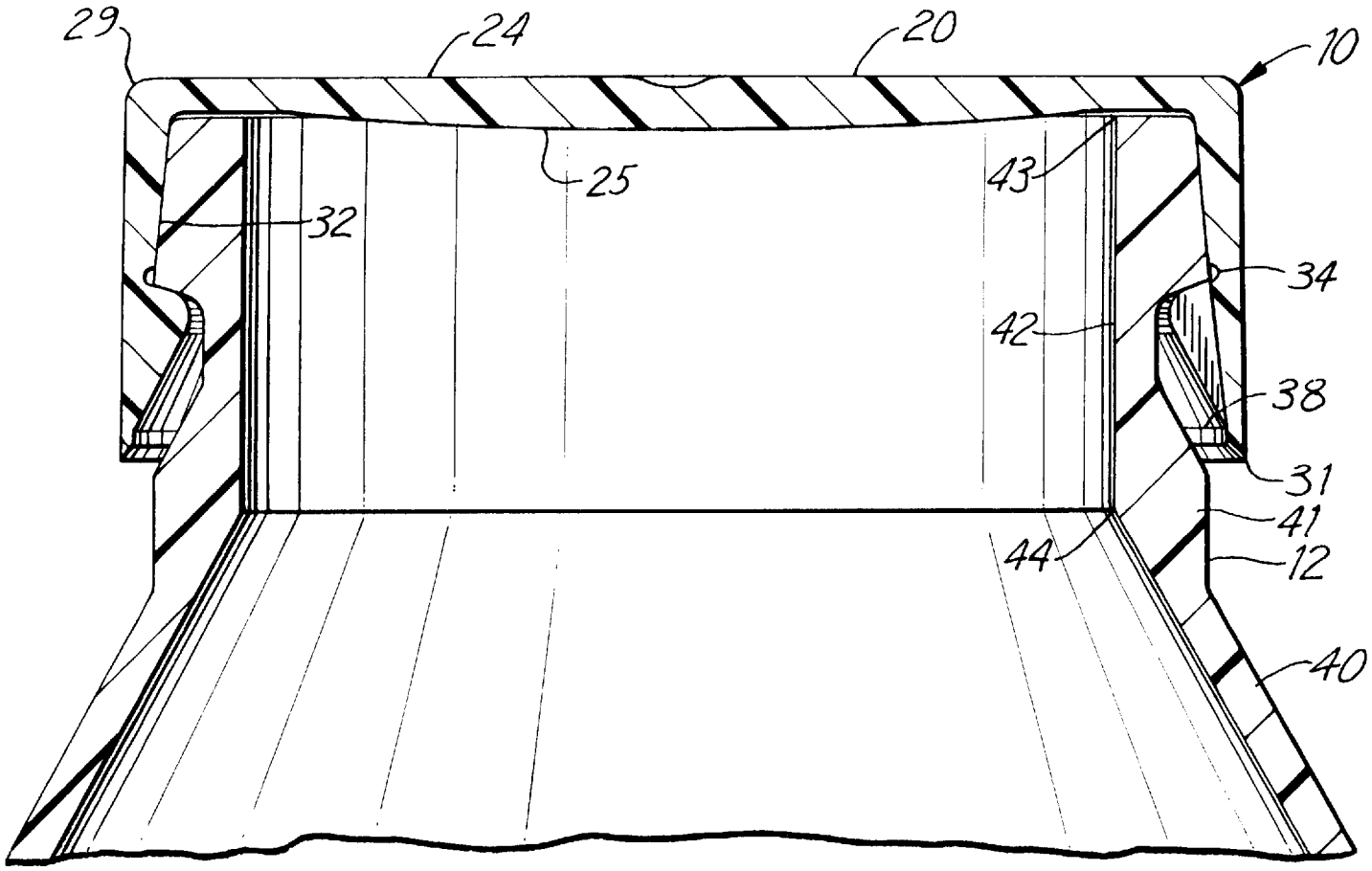
FIG. 3 is a vertical central sectional view showing the engagement of the closure element of FIG. 1 upon the container element shown in FIG. 2.

Because of the tapered configuration of the lower portion of the side wall of the closure, it may be formed using conventional molding techniques. The container element is most conveniently blow-molded from a preform in which the finish has already been precision molded with respect to its dimensions. Once the container is filled, the closure is applied using an axially directed force which spreads the side wall over the container finish until the position shown in FIG. 3 is reached. At this point, it will be observed that the surface 46 in cooperation with the recess 50 accurately positions the closure, which, after positioning, is subjected to a small degree of radially directed stress. Because of the thinness of the planar end wall 20, the pressurized contents may exert a force on the domed portion 25 actually increasing the sealing pressure. This is equally true should a load be placed on the end wall of the closure, occurring, for example, during stacking of the containers. Any radial movement of the end wall should the container be dropped also does not affect the sealing action of the mating frustoconical surfaces.

Removal of the closure is accomplished in normal manner, using a known removal tool (not shown), which engages the lower edge of the side wall. It will be noted that such engagement will immediately distort or rupture the lower edge 31 to give clear evidence of any attempt at tampering. As the closure is removed, the side wall 21 will be distorted outwardly, immediately venting gaseous pressure through the slots 39 within the container past the sealing surfaces, wherein the cap may be removed without explosive effect. Since the removal of the closure will not normally damage the container element, it may be conveniently recycled after use. It should be noted that a small flaw in either of the mating sealing surfaces that does not extend the full width thereof will not affect the sealing action.

Figure 4:
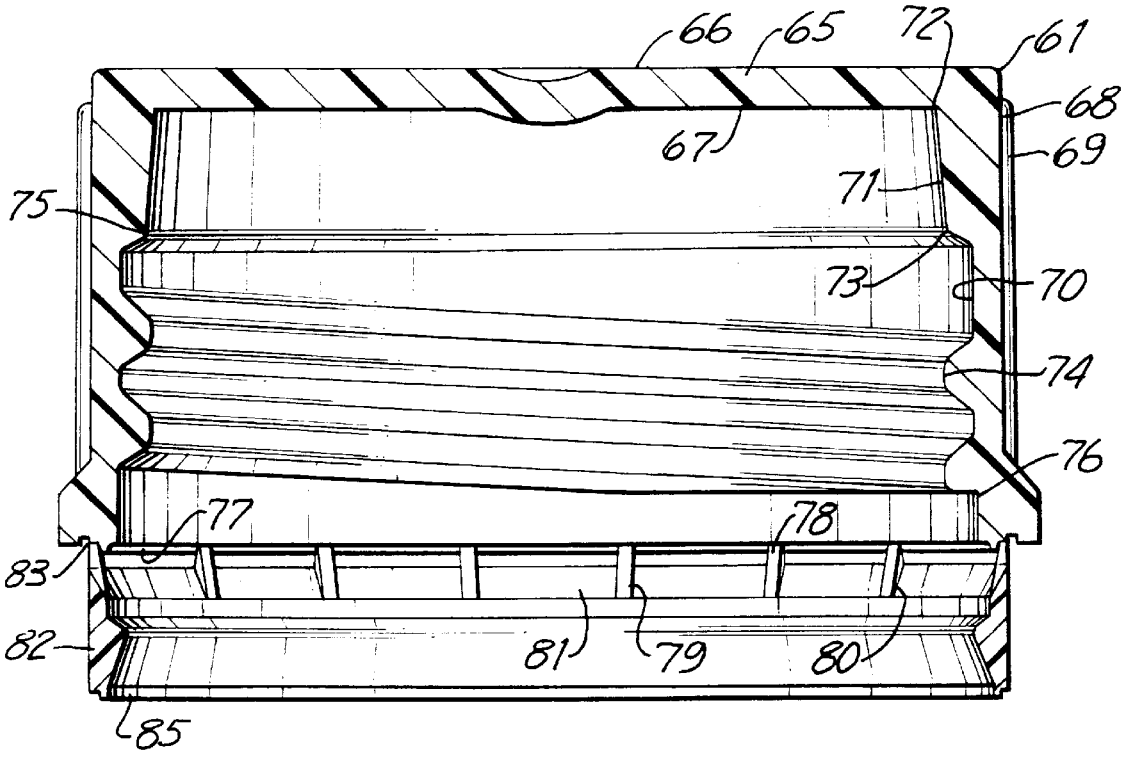
FIG. 4 is a vertical central sectional view of a closure element forming a part of a second embodiment of the invention.
Figure 5:
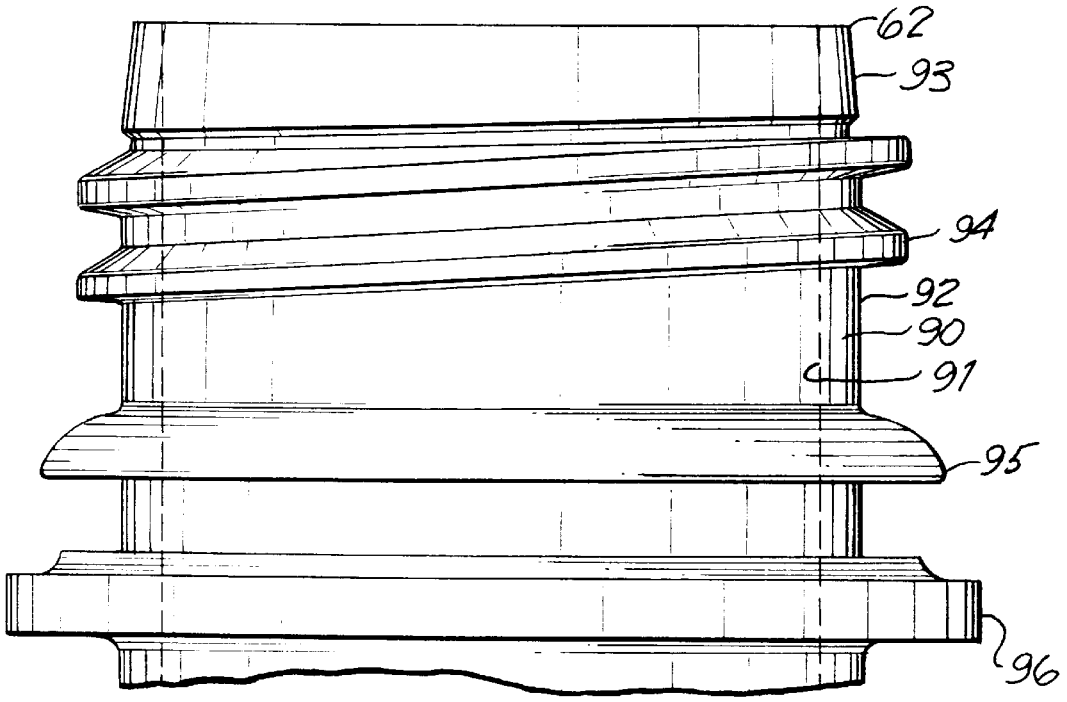
FIG. 5 is a vertical central sectional view of a container element forming another part of the second embodiment.
Figure 6:
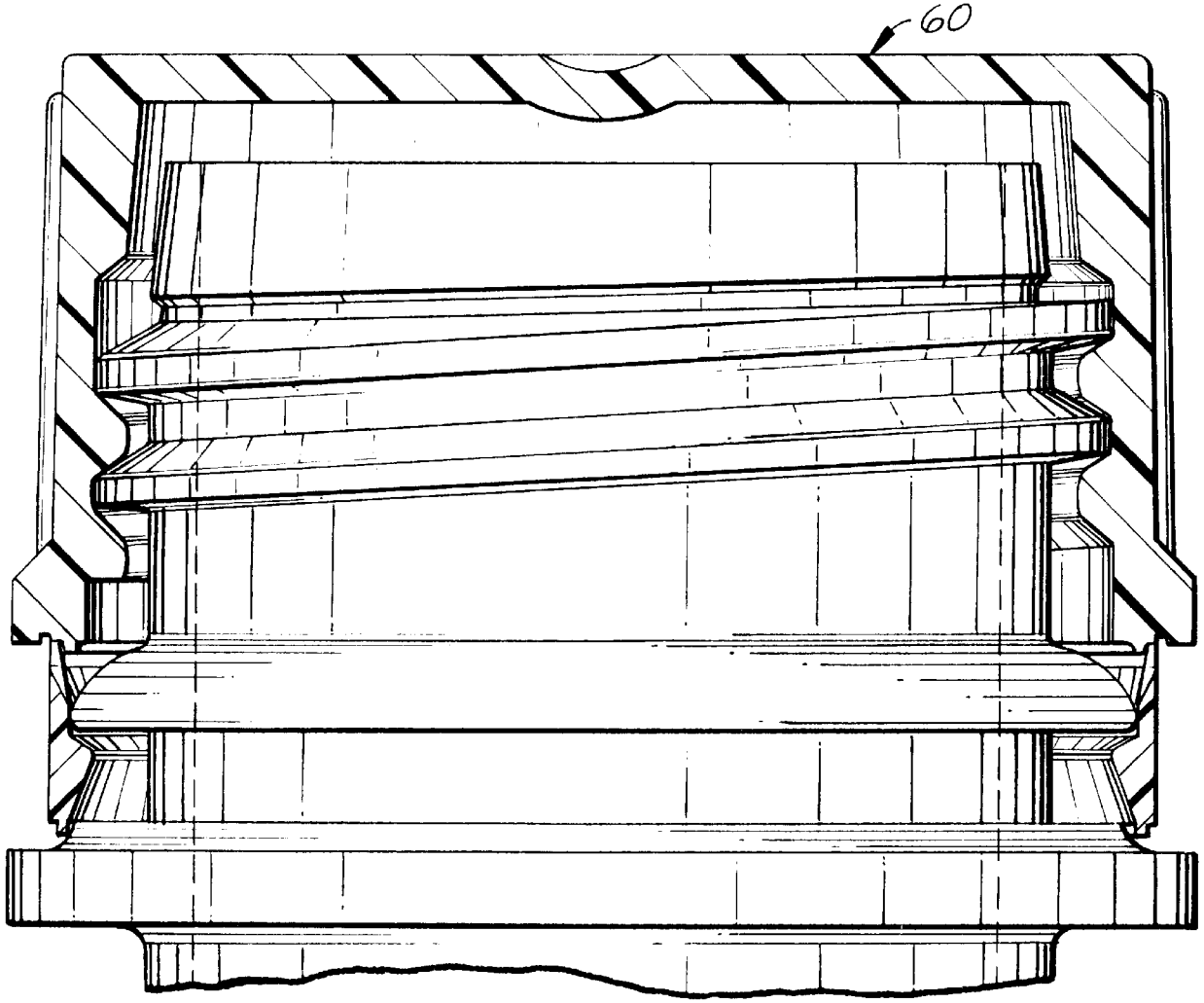
FIG. 6 is a vertical central view showing the engagement of the structure shown in FIG. 4 upon the structure shown in FIG. 5.
Figure 7:
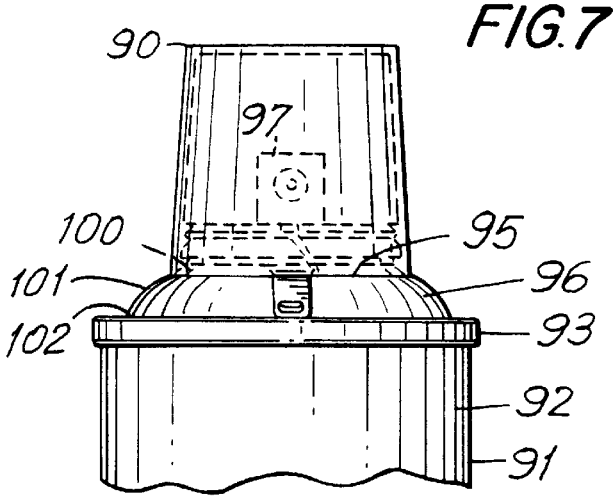
FIG. 7 is a fragmentary side elevational view of a third embodiment of the invention.

Turning now to the second embodiment of the invention illustrated in FIGS. 4, 5, and 6 in the drawing, this embodiment differs from the principal embodiment in that the invention is incorporated into a threaded closure, thus enabling the closure to be reclosable after initial opening. It is particularly suitable for use with containers of relatively larger volume.

In accordance with the second embodiment, the device, generally indicated by reference character 60 (FIG. 6) includes a closure element 61 (FIG. 4), and a container element 62 (FIG. 5).

The closure element 61, as is the case in the first embodiment, is integrally molded from synthetic resinous materials, and includes a planar end wall 65 bounded by an outer surface 66 and an inner surface 67. A cylindrical side wall 68 includes an outer preferably serrated surface 69, and an inner surface 70 which includes a frustoconical sealing area 71 which extends from an upper edge 72 to a lower edge 73. Disposed therebelow is a threaded segment 74 commencing at an upper end 75 and extending to a lower edge 76, to include approximately one and three quarter turns. A lower edge surface 77 mounts the upper ends 78 of triangularly shaped bridge members 79, the lower edges 80 of which terminate in an upper incline surface 81 of a tamper-indicating ring 82 having an annular recessed area 83 which cooperates with a ring retaining bead 84 in known manner.

Referring to FIG. 5, the container element 62 includes a finish or neck 90, having an inner surface 91 and an outer surface 92 which includes a frustoconical sealing area 93 and a threaded section 94 disposed therebelow. A retaining flange 95 cooperates with the tamper indicating ring 82. A second flange 96 engages the lower edge 85 of the ring 82 to discourage tampering using a flat tool employed to pry the ring 82 as the closure is rotated.

After an initial filling of the container, the closure, depending upon its specific construction, can either be rotated into engagement with the container neck, or pushed directly thereupon, the threaded portion of the side wall of the closure being of sufficient durometer that it merely slips over the threads on the container neck until the frustoconical sealing areas are properly seated. When the container is first opened, the tamper indicating ring 82 separates from the remaining part of the closure in known manner, and with continued rotation, the frustoconical sealing areas part contact without damage, so that they may be again reengaged when the closure element is repositioned.

Turning now to the third embodiment of the invention, generally indicated by reference character 90, this embodiment discloses a closure element suitable for use in conjunction with a known aerosol type dispensing device 91 which includes a container body 92, having an upper configured wall 93 defining an opening 94 engaging a valve element 95 including a recessed cup member 96 and a centrally disposed vented push button 97. The cup member 96 includes a peripheral rim 99 having an upper surface 100 and a rounded side surface 101 terminating in a lower free edge 102. In the prior art, this structure is initially enclosed is a relatively rigid cap (not shown) which is dislodged by a hingedly connected manually engageable tab. In the disclosed embodiment, a closure element 105 is injection molded from synthetic resinous material of considerable lower durometer, ideally polyethylene or PET. The closure element 105 includes an upper planar wall 107 merging with a slightly tapered side wall 108 at an upper peripheral edge 109. The side wall 108 includes a lower severable portion 110 which in detached condition forms a tear strip 111. The strip 111 is bounded by an upper interconnecting edge 112 and a lower edge 113. A manually engageable tab 114 is positioned adjacent a frangible area 115 which forms the start of the tear strip when it is removed. The inner surface of the tear strip 116 forms a frustoconical sealing surface which leads to a retaining bead 119 adjacent the lower edge 113.

Figure 8:
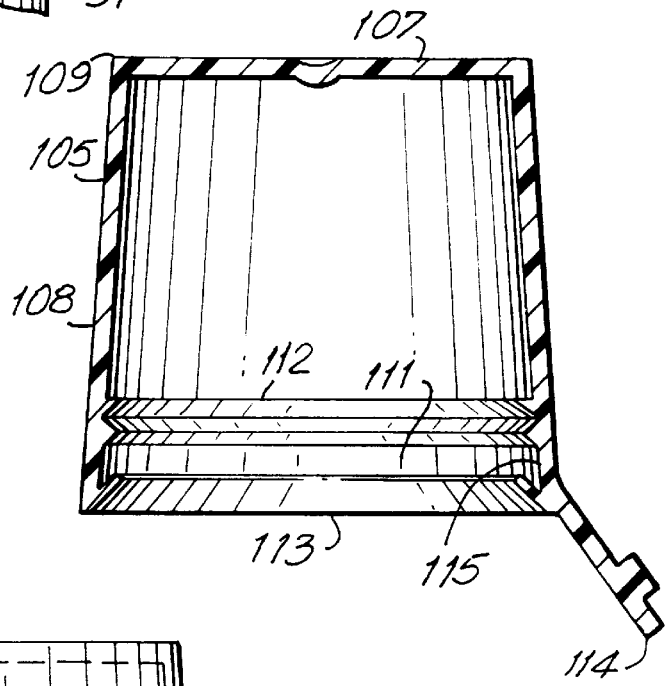
FIG. 8 is an enlarged longitudinal sectional view of the cap element forming a part of the third embodiment.
Figure 9:
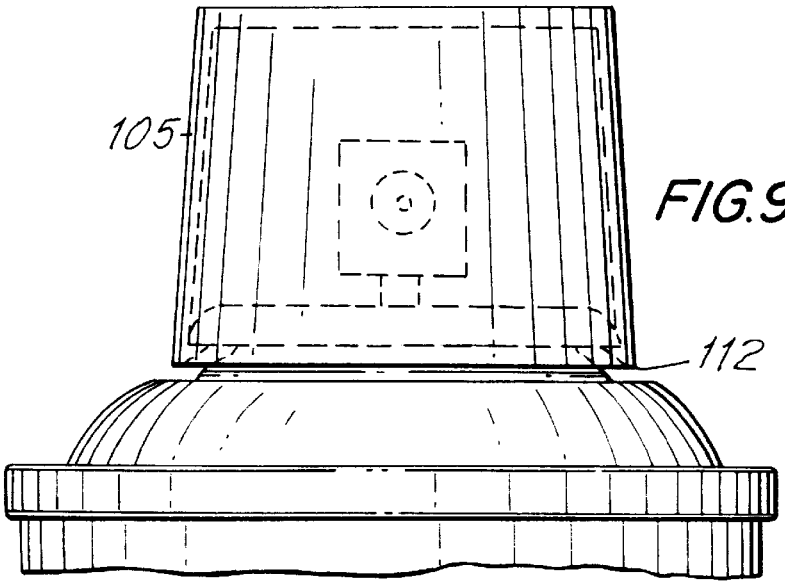
FIG. 9 is a side elevational view, similar to that shown in FIG. 7, but showing the reengagement of the closure element with the container element after removal of a tear strip.

Referring to FIG. 8 in the drawing, the closure is installed by vertically pressing the same into position wherein the bead 29 passes the edge 102, wherein the frustoconical sealing surface engages the surface immediately above the edge 102 which is of slightly tapered configuration.

When the container is first used, the tear strip is manually removed permitting disengagement of the closure element. After a first use, the remaining part of the closure, which is now bounded by a newly formed tapered edge, is engaged to form a non-hermetic closure.

We wish it to be understood that we do not consider the invention to be limited to the precise details of structure shown and set forth in the specification, for obvious modifications will occur to those skilled in the art to which the invention pertains.

We claim:

1. In combination, a synthetic resinous container and closure cap therefore particularly suited for storing liquid contents under pressure; said container having a principal longitudinal axis including a neck finish having an upper portion with an inner surface defining an opening, and an outer surface, said outer surface surrounding said opening and being of frustoconical configuration forming a sealing area, a medially disposed portion on said outer surface defining a closure retaining means; said closure being of flexible semi-rigid material and including an end wall and a generally cylindrical side wall formed integrally therewith; said side wall defining a frustoconical sealing area on an inner surface thereof corresponding to said sealing surface on said container finish adjacent said end wall; and means in the form of an annular bead on said side wall selectively engaging said closure retaining means to maintain said closure upon said finish; said means being distally positioned relative to said end wall, and having venting means operative upon the opening of said container.

2. The combination in accordance with claim 1, said side wall terminating in a free edge spaced from said finish when in engaged condition to permit engagement by a removal tool.

3. The combination set forth in claim 2, wherein said side wall terminates in a thin edge forming tamper indicating means.

4. The combination set forth in claim 1, in which the degree of conicity of said sealing areas is in the order of two degrees to thirty degrees with respect to said principal axis of the container.

5. The combination set forth in claim 1, in which the degree of conicity of said sealing areas is in the order of five degrees with respect to the principal axis of the container.

6. The combination set forth in claim 1, in which said end wall of said closure includes a domed inner surface, said surface being in spaced relation relative to said frustoconical surface on said container when said closure is engaged upon said neck finish.

7. The combination set forth in claim 1 further comprising an area of relatively thin cross section in said side wall positioned immediately above said annular bead whereby to permit radial expansion of said bead during installation of said cap without imparting distortion to said frusto-conical sealing surface.

8. The combination set forth in claim 1 in which said cap in engaged condition upon said container finish defines a clearance between an inner surface of said end wall and said outer surface of said finish wherein upon the presence of a load placed upon said end wall of said cap, said cap may radially expand in said sealing area to increase sealing pressure.

9. A synthetic resinous closure cap for use with a corresponding neck finish on a container, said closure cap including an end wall and a generally cylindrical side wall formed integrally therewith; said side wall having an inner surface defining an annular frusto-conical sealing surface of conical angularity ranging from two degrees to thirty degrees; and segmented bead closure retaining means on said side wall adjacent said sealing surface for engaging corresponding means on said neck finish.

10. A closure cap in accordance with claim 9, in which said conical angularity is approximately five degrees.

11. A closure cap in accordance with claim 9, said side wall including a lowermost portion thereof forming a tear strip, said frustoconical sealing surface being positioned on an inner surface of said tear strip.

12. A closure in accordance with claim 11, in which removal of said tear strip forms a tapered free edge of said side wall for reengaging a container in the absence of said tear strip.

* * * * *